US006532600B2

(12) United States Patent
Brignoli

(10) Patent No.: US 6,532,600 B2
(45) Date of Patent: Mar. 18, 2003

(54) MARTIAL ARTS BELT

(76) Inventor: Joseph S. Brignoli, 840 Sanctuary Dr., Palm Beach Gardens, FL (US) 33410

( * ) Notice: Subject to any disclaimer, the term of this patent is extended or adjusted under 35 U.S.C. 154(b) by 0 days.

(21) Appl. No.: 09/969,058

(22) Filed: Oct. 1, 2001

(65) Prior Publication Data

US 2002/0157171 A1 Oct. 31, 2002

Related U.S. Application Data

(63) Continuation-in-part of application No. 09/140,445, filed on Apr. 17, 2001.

(51) Int. Cl.[7] ..... A41F 9/00
(52) U.S. Cl. ..... 2/311
(58) Field of Search ..... 2/311, 16, 22, 2/24, 312–319, 320, 321, 322, 326, 336, 338, 171, 144, 148, 151, 154, 156, 910, 919, 920, DIG. 11; D2/624, 627, 629, 306, 442

(56) References Cited

U.S. PATENT DOCUMENTS 3,256,882 A * 6/1966 Huber ..... 128/DIG. 15
4,991,234 A * 2/1991 Greenberg ..... 2/16
4,999,853 A * 3/1991 Tanner ..... 2/321
5,299,325 A * 4/1994 Kamber et al. ..... 2/338
5,539,933 A * 7/1996 Garber et al. ..... 2/311
6,226,797 B1 * 5/2001 Tollini ..... 2/22

* cited by examiner

*Primary Examiner*—John J. Calvert
*Assistant Examiner*—Tejash Patel
(74) *Attorney, Agent, or Firm*—McHale & Slavin

(57) ABSTRACT

A martial arts belt having a pre-tied knot which is secured with hook and loop fastening material. The martial arts belt includes a belt portion and a knot portion which are fixedly attached to one another. The belt portion has a length sufficient to encircle the waist of a wearer twice. The knot portion is a facsimile of the knot in a hand-tied belt which includes a centrally positioned knot and a first end portion and a second end portion depending freely from the knot. The knot portion is fixedly attached to the front surface of the belt portion proximate to the first end of the belt portion. The martial arts belt includes at least one securement to fasten the belt around the waist of a wearer. The securement can include mated portions of hook and loop fastening material. When worn, the belt of the present invention has the appearance of a martial arts belt which has been hand-tied in the traditional manner.

4 Claims, 4 Drawing Sheets

MARTIAL ARTS BELT

CROSS REFERENCE TO RELATED APPLICATIONS

This application is a continuation-in-part of applicant's co-pending U.S. application Ser. No. 09/140,445 filed Apr. 17, 2001, the contents of which are hereby incorporated by reference.

FIELD OF THE INVENTION

This invention relates generally to the field of sports equipment for the martial arts, and more specifically to a martial arts belt having a pre-formed knot.

BACKGROUND OF THE INVENTION

The traditional martial arts jacket is secured by tying and knotting an obi, which is a belt or sash worn around the waist. In the philosophy of the martial arts, the obi is not considered to be mere securement mechanism, but has many symbolic meanings. The color of the obi has great significance. Traditionally, in karate, a beginner would be given a white obi, which in time would become soiled from handling and use until it turned brown, and would become progressively darker until it turned black. Hence, the tradition of the three primary belt colors, white, brown and black, to designate the stages of learning.

Another symbolic aspect of the obi is the manner in which it is worn. One interpretation holds that when properly worn, the obi encircles the hara or tanden, which is the center of a person. The hara, a point about three inches below the navel, is thought in Zen Buddhism to be the center of the self, and symbolically the center of the cosmos, and chi, or the life force. The knot of the obi usually touches the hara. The length of both sides of the belt from the knot to the end must be equal, which is said to symbolize the equal development of man and body.

In order to tie the correct traditional knot in the belt, a precise series of steps must be followed. First the belt is folded in half with the ends together to exactly locate the center. The center is placed on the stomach. Both ends are wrapped around the waist and crossed in the back. The ends are brought around to the front, and the end in the right hand is crossed over the end in the left hand. The wearer then switches hands on the belt ends and the end in the left hand is slipped under both pieces of belt on the wearer's waist. After tightening the belt, the wearer takes the end in the left hand and holds it in front of the body, and the end in the right hand is bent over the left. Then the end in the left hand is bent over the right hand end, up and through the knot, and the knot is tightened. The left and right hand ends should be equal in length.

An instructional course in the martial arts begins with a lesson on the proper way to tie the belt. For an instructor teaching martial arts classes to children, especially large classes, certain practical problems can arise with regard to the tying of the belt. Young children can find the proper belt tying technique difficult to master. Many instructors find that a significant portion of the entire allotted class time can be consumed before each child is able to tie the knot correctly.

Another problem with the belt is that the rigidity and width of the belt material can make it difficult to tighten the knot to a great degree. Consequently, the knot may become unraveled. Having the belt become loosened and untied during a match can create a dangerous situation because the participants may trip over the belt.

Thus, it would be desirable to provide a martial arts belt means to quickly achieve the appearance of traditional martial arts attire by providing a self-fastening belt having a pre-formed knot which creates a facsimile of a traditionally tied belt.

SUMMARY OF THE INVENTION

It is an objective of the invention to provide a martial arts belt having a fixed pre-formed knot which creates a facsimile of a traditionally tied martial arts belt.

It is another objective to provide a martial arts belt having a fixed pre-formed knot which can be quickly fastened and unfastened.

It is still another objective to provide a martial arts belt having a fixed pre-formed knot which utilizes hook and loop fastening material to fasten the belt.

It is a further object of the invention to provide a martial arts belt having a fixed pre-formed knot which can be easily fastened by children.

It is yet a further object of the invention to provide a martial arts belt having a fixed pre-formed knot which cannot become loosened and untied.

It is still a further object of the invention to provide a martial arts belt having a fixed pre-formed knot which can be adjusted to the correct size for the wearer.

It is yet another objective of the invention to provide a martial arts belt for use in a class environment which will enable students to quickly achieve a neat, uniform appearance.

In accordance with the above objectives, the present invention discloses a martial arts belt which is secured with hook and loop fastening material. The martial arts belt has a pre-tied knot which gives the martial art belt of the present invention the appearance of a martial arts belt which has been hand-tied in the traditional manner. The martial arts belt comprises a belt portion and a knot portion which are fixedly attached to one another. The belt portion has a first end and a second end, and a length sufficient to encircle the waist of a wearer at least one time. In a preferred embodiment, the belt portion has a length sufficient to encircle the waist of the wearer twice. The knot portion includes a centrally positioned knot and a first end portion and a second end portion depending freely from the knot. The first end portion and the second end portion are preferably approximately equal in length. The knot portion is fixedly attached to the front surface of the belt portion proximate to the first end of the belt portion.

The martial arts belt includes at least one securement means to fasten the belt around the waist of a wearer. The securement means can include a first securement means which comprises first and second mated portions of hook and loop fastening material (such as VELCRO™) which are respectively attached to the front surface of the belt portion proximate to the second end and the back surface of the belt portion substantially at the center of the belt portion; and a second securement means which comprise first and second mated portions of hook and loop fastening material which are respectively attached to the front surface of the belt portion substantially at the center of the belt portion and the back surface of the belt portion proximate to the first end.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
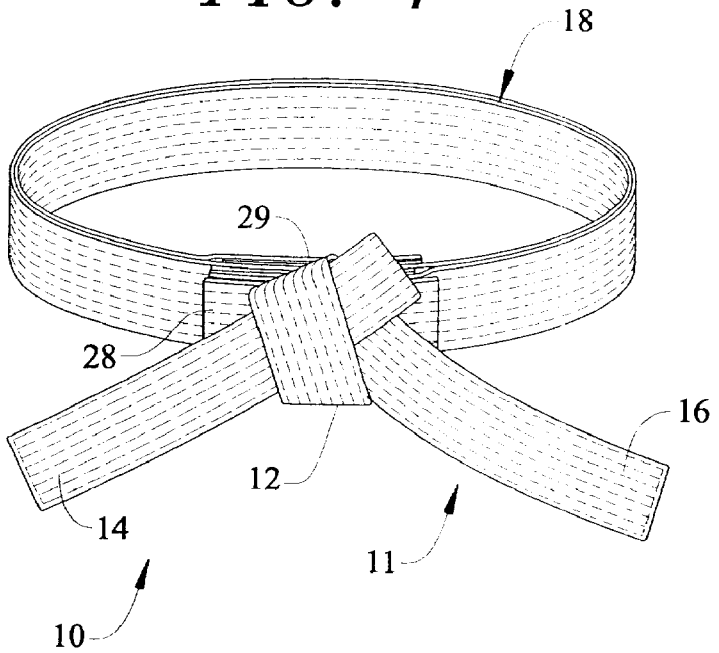
FIG. 1 is a perspective view of a martial arts belt according to a preferred embodiment of the invention in a fastened configuration.

FIG. 1 illustrates the appearance of a martial arts belt 10 according to a preferred embodiment of the invention in a fastened configuration. In the fastened configuration, the martial arts belt 10 preferably has the appearance of a martial arts belt which has been hand-tied in the traditional manner. The martial arts belt 10 is constructed of fabric, and can be constructed from fabric which would be typically used for hand-tied martial arts belts. The material preferably has a foam core with a series of lateral quilting stitches which provide a degree of rigidity to the material.

Figure 1A:
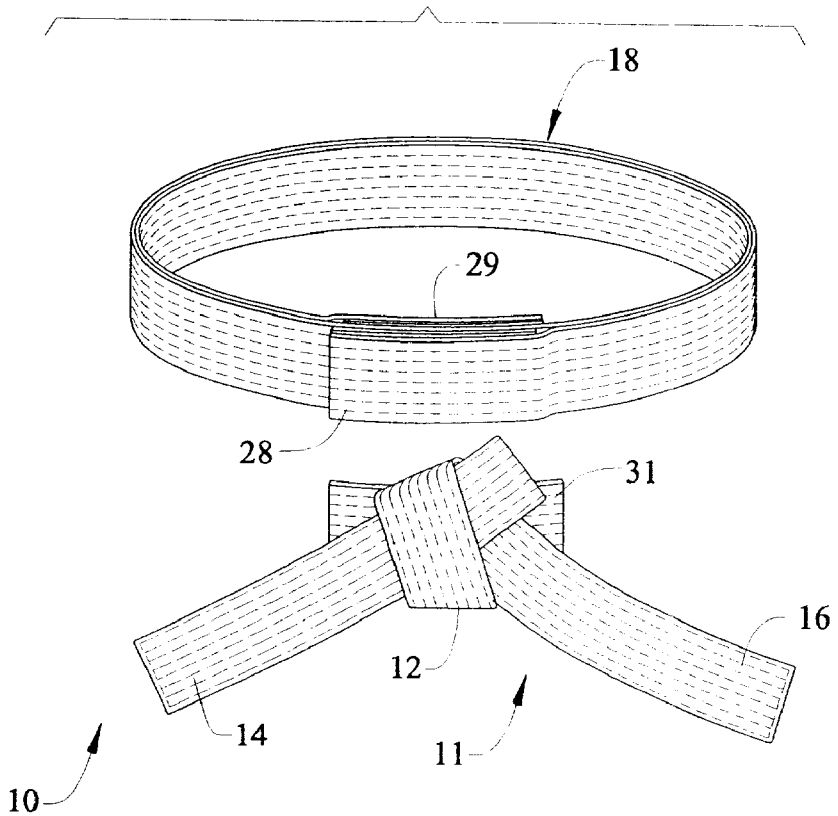
FIG. 1A is an exploded view of the martial arts belt shown in FIG. 1, in which the knot portion is shown separated from the belt portion.

As best seen in the exploded view shown in FIG. 1A, the martial arts belt 10 includes a belt portion 18 and a knot portion 11 which are constructed from identical materials. The belt portion 18 preferably has a length sufficient to wrap twice around the waist of a wearer in order to simulate the appearance of a traditionally tied belt. The knot portion 11 has a knot 12 which is preferably a facsimile of the traditional knot which is tied in martial arts belt. Freely depending first and second end portions 16 and 14 extend from the knot 12. In the preferred embodiment, the knot 12 and first and second end portions 16 and 14 are fashioned from a single length of belt material by tying a square knot in the center of the belt material, preferably by tying the length of belt material around a separate portion 31 of belt material having the same width to create the appearance of a traditionally tied knot. In the preferred embodiment, the knot portion 11 is fixedly attached to a first end 28 of the belt portion 18, preferably by stitching. The knot portion 11 can also be glued to the belt portion 18.

Figure 2:
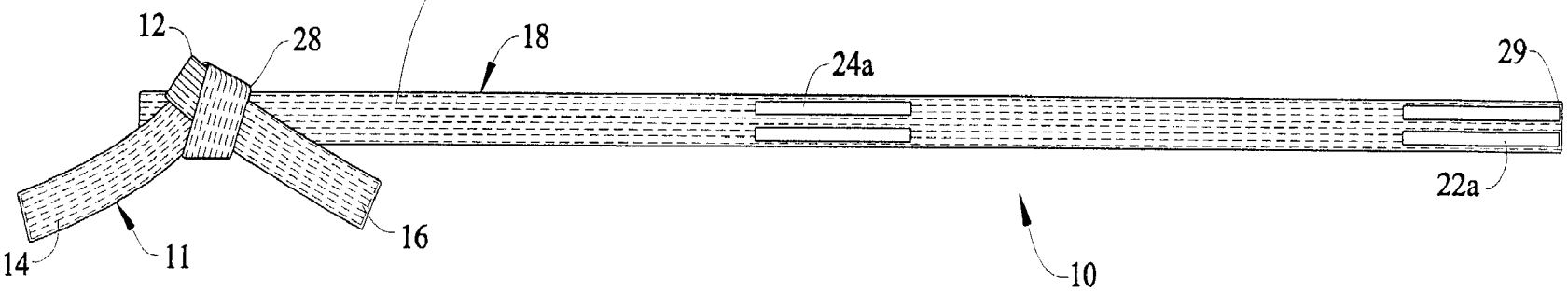
FIG. 2 is a front elevational view of the martial arts belt shown in FIG. 1 in an open configuration.
Figure 3:
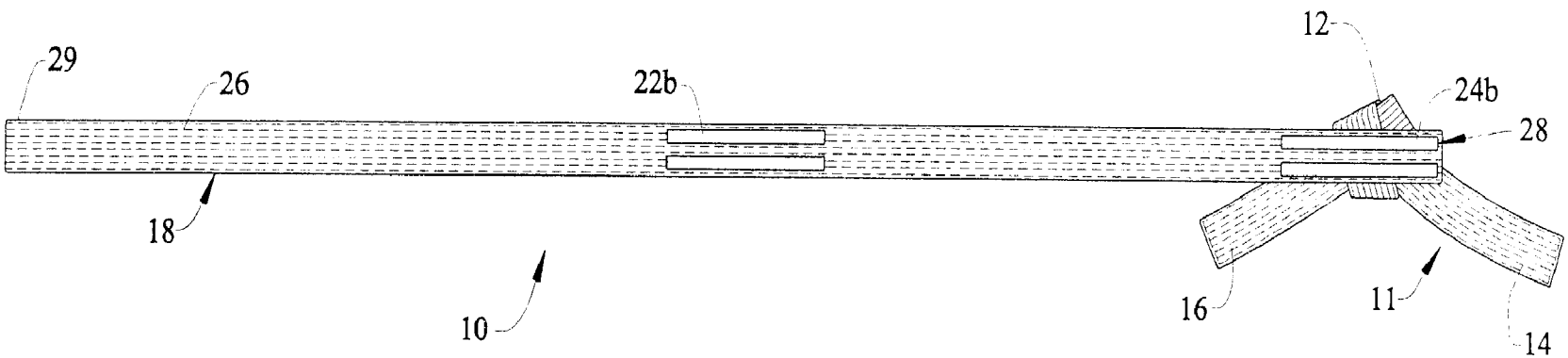
FIG. 3 is a rear elevational view of the martial arts belt shown in FIG. 1 in a open configuration.
Figure 4:
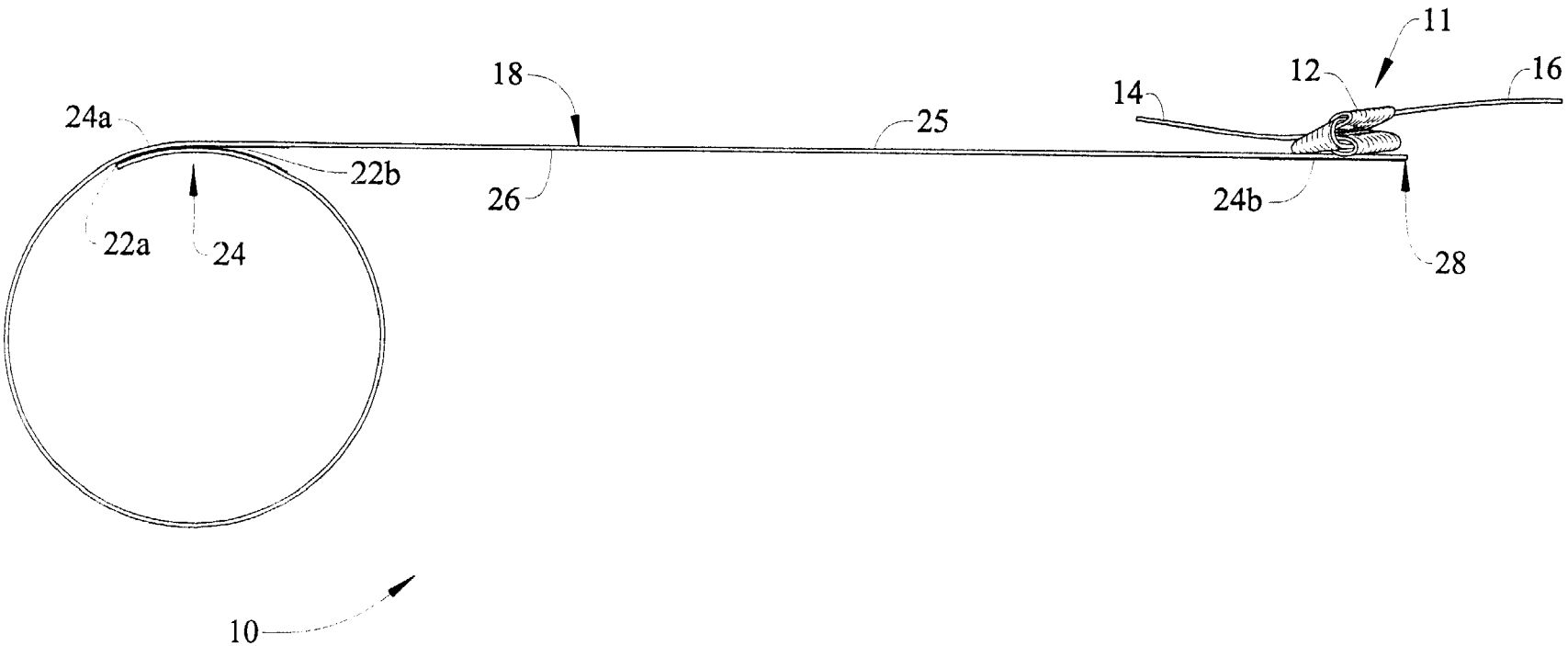
FIG. 4 is a top plan view of the martial arts belt shown in FIG. 1 in an partially fastened configuration.
Figure 5:
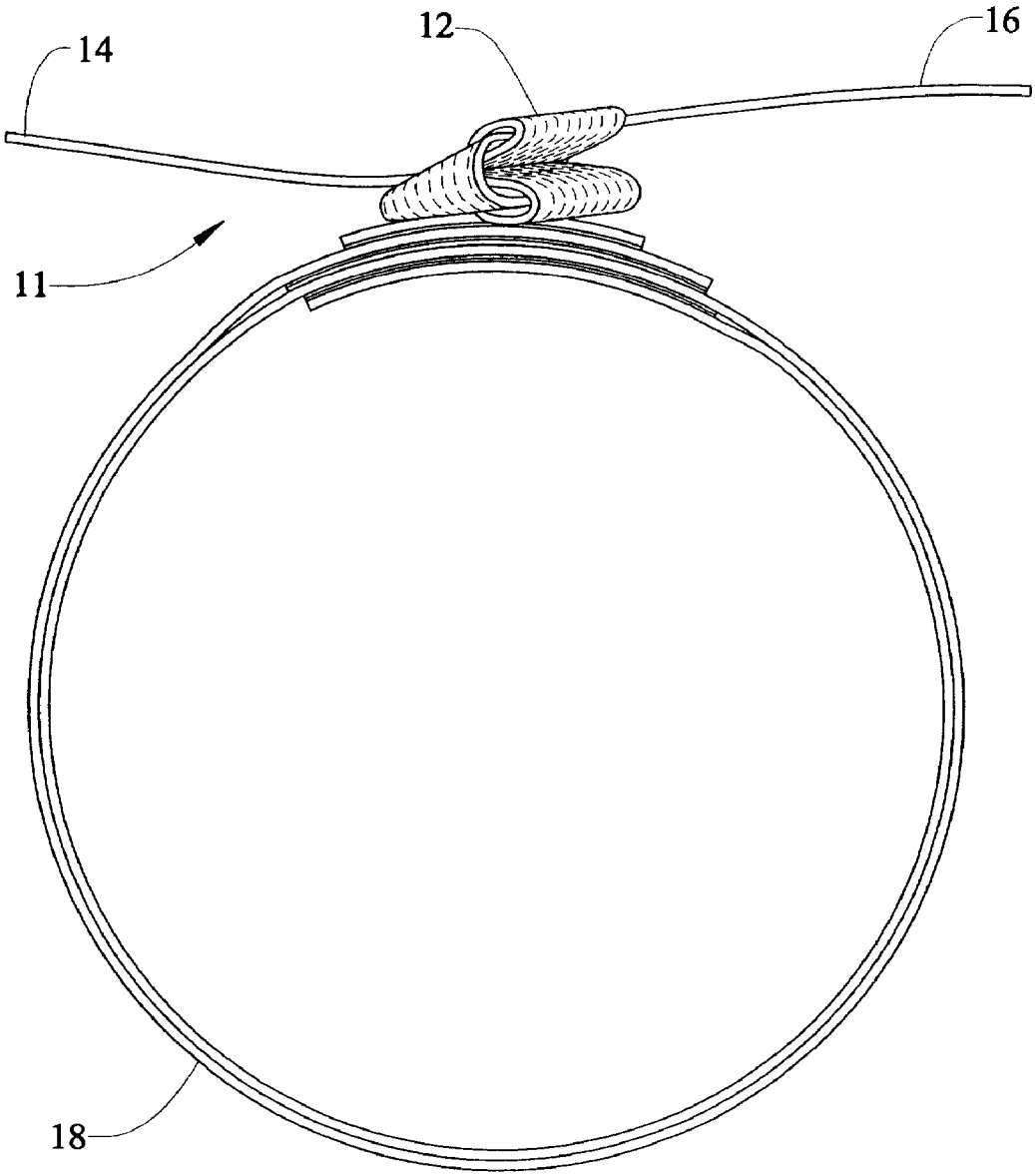
FIG. 5 is a top plan view of the martial arts belt according to a preferred embodiment of the invention in a fastened configuration.

FIGS. 2 and 3 illustrate a front and back views respectively of the martial arts belt 10 in an unfastened, extended configuration. The martial arts belt 10 includes securement means to fasten the belt around the waist of a wearer. The securement means preferably allows the belt to be quickly and easily fastened and removed. In the preferred embodiment, the martial arts belt includes portions of mated hook and loop fastening material, such as VELCRO, which are stitched or otherwise fixedly attached to the belt portion 18. As seen in FIGS. 2 and 3, the martial arts belt 10 includes a first securement means consisting of mated fastening material portions 22*a* and 22*b* and a second securement means consisting of mated fastening material portions 24*a* and 24*b*. In the illustrated embodiment, the fastening material portions 22*a* is attached to front surface 25 of the belt portion 18 proximate to the second end 29, fastening material portion 22*b* is attached to the back surface 26 of the belt portion 18 at the center of the belt portion 18, the fastening material portion 24*a* is attached to the front surface 25 of the belt portion 18 at the longitudinal center, and fastening material portion 24*b* is attached to the back surface 26 of the belt portion 18. While illustrated embodiment utilizes two sets of mated VELCRO portions, the invention is not limited in this regard. The martial arts belt 10 can be constructed with any number of VELCRO fasteners. The fastening material portions 22*a,b* and 24*a,b* can have any suitable shape and size, however they are preferably elongated to facilitate size adjustment for the individual wearer. FIG. 4 illustrates the martial arts belt 10 in a partially fastened configuration. In use, the wearer would position the second end 29 near the center of the wearer's waist so that the front surface 25 is outwardly oriented. The knot portion 12 is oriented so that the end portions 14 and 16 extend downwardly. The belt portion 18 is wrapped around the waist of the wearer so that mated fastening material portions 22*a* and 22*b* engage. The belt portion 18 is wrapped a second time around the wearer so waist until the mated fastening material portions 24*a* and 24*b* are aligned and then engaged, as shown in FIG. 5. The alignment of the mated fastening material portions 22*a,b* and 24*a,b* can be laterally adjusted to adjust the fit of the martial arts belt 10.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. A relative rigid martial arts belt adapted to be worn about a wearer's waist, comprising:

a belt portion having a length sufficient to encircle the waist of a wearer at least twice, said belt portion having a first end, a second end, a center, a front surface, and a back surface;

a knot portion including a knot and a first end portion and a second end portion depending freely from said knot; said first and second end portions each having a length; said knot portion being fixedly attached to said front surface of said first end of said belt portion;

a first securement means defined by first and second mated portions of hook and loop fastening material, said first portion of fastening material attached to said front surface of said belt portion proximate to said second end; said second portion of fastening material fixedly attached to said rear surface of said belt portion substantially at said center of said belt portion; and a second securement means defined by first and second mated portions of hook and loop fastening material, said first portion of fastening material attached to said front surface of said belt portion substantially at said center of said belt portion; said second portion of fastening material fixedly attached to said rear surface of said belt portion proximate to said first end whereby said belt portion encircles the waist of the wearer and said back surface of said first end is fastened to said front surface of said center, said back surface of said center is fastened to said front surface of said second end.

2. The martial arts belt according to claim 1, wherein said first and second end portions of said knot portion are substantially equal in length.

3. The martial arts belt according to claim 1, wherein said belt portion is constructed from fabric.

4. The martial arts belt according to claim 1, wherein said knot portion is constructed from fabric.

* * * * *